US006899556B2

(12) United States Patent
Nishida et al.

(10) Patent No.: US 6,899,556 B2
(45) Date of Patent: May 31, 2005

(54) ELECTRICAL CONNECTION SYSTEM

(75) Inventors: Atsushi Nishida, Toyota (JP); Takayuki Hori, Aichi (JP); Masato Minakata, Toyota (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/453,807

(22) Filed: Jun. 3, 2003

(65) Prior Publication Data

US 2003/0228782 A1 Dec. 11, 2003

(30) Foreign Application Priority Data

Jun. 6, 2002 (JP) ..... 2002-165493

(51) Int. Cl.[7] ..... H01R 13/50
(52) U.S. Cl. ..... 439/188; 200/51.1
(58) Field of Search ..... 439/188, 331, 439/372, 507, 509; 200/51.1

(56) References Cited

U.S. PATENT DOCUMENTS 5,275,575 A * 1/1994 Cahaly et al. ..... 200/51.1
5,326,271 A * 7/1994 Kishi et al. ..... 439/72
5,376,017 A 12/1994 Taniuchi et al. ..... 439/372
5,399,103 A * 3/1995 Kuboshima et al. ..... 439/509
5,616,045 A * 4/1997 Gauker ..... 439/352
6,053,762 A * 4/2000 Matsumura et al. ..... 439/484
6,419,510 B2 * 7/2002 Shiraki et al. ..... 439/188
6,435,894 B2 * 8/2002 Little et al. ..... 439/352

FOREIGN PATENT DOCUMENTS

EP 1 049 209 A1 11/2000 ..... H01R/13/346
EP 1 130 692 A2 9/2001 ..... H01R/13/639
JP 2001319747 A * 11/2001 ..... H01R/31/08

OTHER PUBLICATIONS

European Search Report dated Oct. 30, 2003 (3 pages).

* cited by examiner

*Primary Examiner*—Renee Luebke
(74) *Attorney, Agent, or Firm*—Osha & May L.L.P.

(57) ABSTRACT

An electrical connection system includes (1) a jack holding a pair of pins, (2) a plug holding a pair of electrical terminals respectively engaging with the above pins, (3) a shorting clip provided in the above jack for electrically shorting out the pins each other, (4) a latch unit provided in the above plug and (5) a cover provided in the above jack so as to be freely rotatable. The latch unit is movable between a first position where the shorting clip shorts out the pins and a second position where the shorting clip is moved to a non-shorting position. Rotation of the cover allows the plug to engage with the jack and the above latch unit to move to the above second position.

3 Claims, 18 Drawing Sheets

ELECTRICAL CONNECTION SYSTEM

BACKGROUND OF INVENTION

1. Field of the Invention

The present invention relates to a technical field of an electrical connection system, particularly, an electrical connection system comprising a second component provided with a latch element in which an electrical contact of a first component is shorted out when the first component and the second component is not properly electrically connected while shorting of the above electrical contact is canceled when the first and second components are electrically connected.

2. Description of the Related Art

There is conventionally known a connection system comprising two components respectively provided with a pair of electrical connector elements (a plug and a jack, for example), the connection system being arranged so that connection between the plug and the jack would allow the electrical connector elements to be electrically connected to each other. There is also known a connection system having a jack with a shorting element in which the above-mentioned pair of connector elements can be electrically shorted with each other when a plug is not connected with the jack.

Furthermore, there is known a structure comprising a latch element on a plug side. The latch element may be latched at a first latch position when the plug is separated from the jack while pushed. A second latch position is characterized by the plug being completely engaged with the jack so that the above-mentioned shorting element cancels the shorting, and in which mechanical locking is achieved so that the plug would not come out from the jack. Such a structure is disclosed in U.S. Pat. No. 5,314,345 and JP 2,647,335, for example.

The above-mentioned structure can be effectively used in a repeater device repeating a signal for operating an air bag system of a vehicle. For example, the above-mentioned structure may function as a connecting device for connecting the repeater device and a controller device.

The air bag system comprises an air bag assembly mounted in a driving room of a vehicle, an electrical or electronic controller device, and a repeater device. In a general way of mounting such air bag system, the air bag assembly, the controller device, and the repeater device are first separately mounted to a vehicle. Then, (A) the controller device and the repeater device and (B) the repeater device and the air bag assembly are electrically connected by means of a wire harness.

In a structure in which the controller device and the repeater device are connected as described in (A), the above plug is mounted to one end of a pair of wire harnesses. The other end of the pair of wire harnesses is connected to the controller device. Conductors of the pair of wire harnesses are connected to a pair of terminals of the plug (electrical connector elements), respectively. The above-mentioned jack having a pair of terminals (electrical connector elements) is provided on the same side as the repeater device.

In accordance with the above structure, an easy operation of inserting a plug into a jack connects the controller device to the repeater device. The pair of terminals on the jack side can be electrically shorted by the above shorting element when the plug is not inserted into the jack. Shorting the pair of terminals during installation of an air bag system in a vehicle prevents the leak of charges and flow of current to the air bag assembly side caused by incorrect connection, which can accidentally cause the air bag assembly to open.

Changing the latch position of the latch element after the plug is inserted into and engaged with the jack cancels the shorting and mechanically locks the plug and the jack. Thus, the electrical connection between the controller device and the repeater device is stably secured.

When used as a repeating device, the above structure may, for example, function as a switch for switching an air bag between operation and non-operation.

That is to say, a structure capable of switching an air bag between operation and non-operation is required in some cases due to any circumstances such as legal restriction. In such case, providing a switch as a repeating device in a connecting circuit between the controller device and the air bag assembly allows an air bag operation signal from the controller device to be intercepted from the air bag assembly when the switch is switched to an OFF side. Non-operation of an air bag can be thus achieved.

A structure in which such switching function is directly provided in the controller device can also be considered. In this case, a repeater device as mentioned above is not necessary. An advantage in using a repeater device as described above is that a conventional controller device having no switching function as described above can be used as it is without the need to change the design of the controller device.

As described above, the shorting element is for preventing an accidental operation of the air bag assembly before inserting a plug into a jack. Therefore, shorting between the terminals by means of the shorting element should be canceled after the plug is inserted into and engaged with the jack. That is to say, the above latch element is necessarily moved to the second latch position after the plug is inserted into the jack.

The latch element is typically a small component and, as a result, it is difficult to check whether the latch element is at the second latch position. Therefore, cancellation of shorting is often forgotten. When it is found in inspection that shorting has not been canceled after subsequent assembling work has been performed, what has been assembled must be disassembled in order to access to the plug. This requires a reassembling operation after moving the latch element to the second latch position, which causes a great trouble.

SUMMARY OF THE INVENTION

An object of the invention is to provide an electrical connection system capable of easily checking whether a plug and a jack are engaged and latched.

Another object of the invention is to provide an electrical connection system in which a connecting operation is easy, and time and cost in connecting can be saved.

In accordance with a first aspect of the invention, an electrical connection system comprises: a first component holding a pair of first electrical connector elements; a second component holding a pair of second electrical connector elements respectively engaged with the above first electrical connector elements; a shorting element mounted to the above first component for electrically shorting the above first electrical connector elements each other; a latch element mounted to the above second component, the latch element being capable of moving between a first position for shorting the above first electrical connector elements by means of the above shorting element and a second position for moving the shorting element to a non-shorting position; and a rotating member provided in the above first component so as to be freely rotatable, rotation of the rotating member making the second component engage with the first component and making the above latch element move to the above second position.

Accordingly, one operation of rotating the rotating member enables the second component to engage with the first component and the latch element to move to the second position. Furthermore, engagement of the components and movement of the latch element to the second position can be easily confirmed by checking the position of the rotating member, so that an operational mistake such as the accidental engagement of the components or forgetting to move the latch element to the second position can be prevented from occurring.

In accordance with a second aspect of the invention, an electrical connection system is provided wherein movement of the above latch element to the second position is limited when the above second component is not engaged with the above first component.

The both components can be engaged by adding force to the latch element. After the engagement, adding force to the latch element allows the latch element to move to the second position. Thus, a structure in which a connecting condition can be achieved by only one operation (an operation of rotating the rotating member) as a whole can be easily obtained.

In accordance with a third aspect of the invention, an electrical connection system is provided wherein a direction that the above second component moves to engage with the above first component is the same as a direction that the above latch element moves from the above first position to the above second position.

Accordingly, one operation of rotating the rotating member allows engagement of the second component with the first component and movement of the latch element to the second position to be smoothly and cooperatively performed.

In accordance with a fourth aspect of the invention, an electrical connection system is provided wherein pushing the above latch element by means of the above rotating member allows the above second component to be successively engaged with the first component, and also allows the above latch element to move from the first position to the second position.

Accordingly, one operation of rotating the rotating member allows engagement of the second component with the first component and movement of the latch element to the second position to be successively carried out, so that time and trouble in a connecting operation can be reduced.

In accordance with a fifth aspect of the invention, an electrical connection system is provided wherein engagement of the second component with the first component allows latch element to move from the first position to the second position.

The pushing force from the rotating member to the latch element can be used to engage the second component with the first component. On the other hand, the pushing force from the rotating member to the latch element can be used to move the latch element to the second position after both components are engaged. Accordingly, engagement of the second component with the first component and movement of the latch element to the second position can be successively and smoothly carried out, so that time and trouble in a connecting operation can be reduced.

In accordance with a sixth aspect of the invention, an electrical connection system is provided wherein the rotating member is provided with a rotating shaft at one end, and wherein the rotating member rotates so that the middle portion thereof pushes the latch element.

Accordingly, when the rotating shaft is used as a fulcrum, it is possible to strongly push the latch element using leverage even when the force added to the rotating member is light. Therefore, force necessary for an assembling operation is reduced, which reduces the fatigue of an assembling operator.

In accordance with a seventh aspect of the invention, an electrical connection system is provided with a fixing unit for fixing the rotating member on the above first component.

Accordingly, the rotating member can be fixed so as not to rotate after connection of the first component and the second component, which prevents disruption of subsequent operations increases work efficiency.

In accordance with an eighth aspect of the invention, an electrical connection system is provided wherein the above rotating member restricts both movement of the latch element to the first position and disengagement of the second component from the first component when the rotating member is fixed on the first component by means of the fixing unit.

Accordingly, fixing the rotating member can lock the electrical connector elements so that they are not shorted by each other and the connection between the components is not released. Thus, it is possible to prevent the first and second components from being released accidentally.

In accordance with a ninth aspect of the invention, provided an electrical connection system wherein the above rotating member is formed into the shape of a cover so as to cover the second component engaged with the above first component.

Accordingly, using a cover to veil the second component connected with the first component allows the system to be protected from any shock. Therefore, electrical connection between the first component and the second component is superior in stability and certainty.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENT

Figure 1:
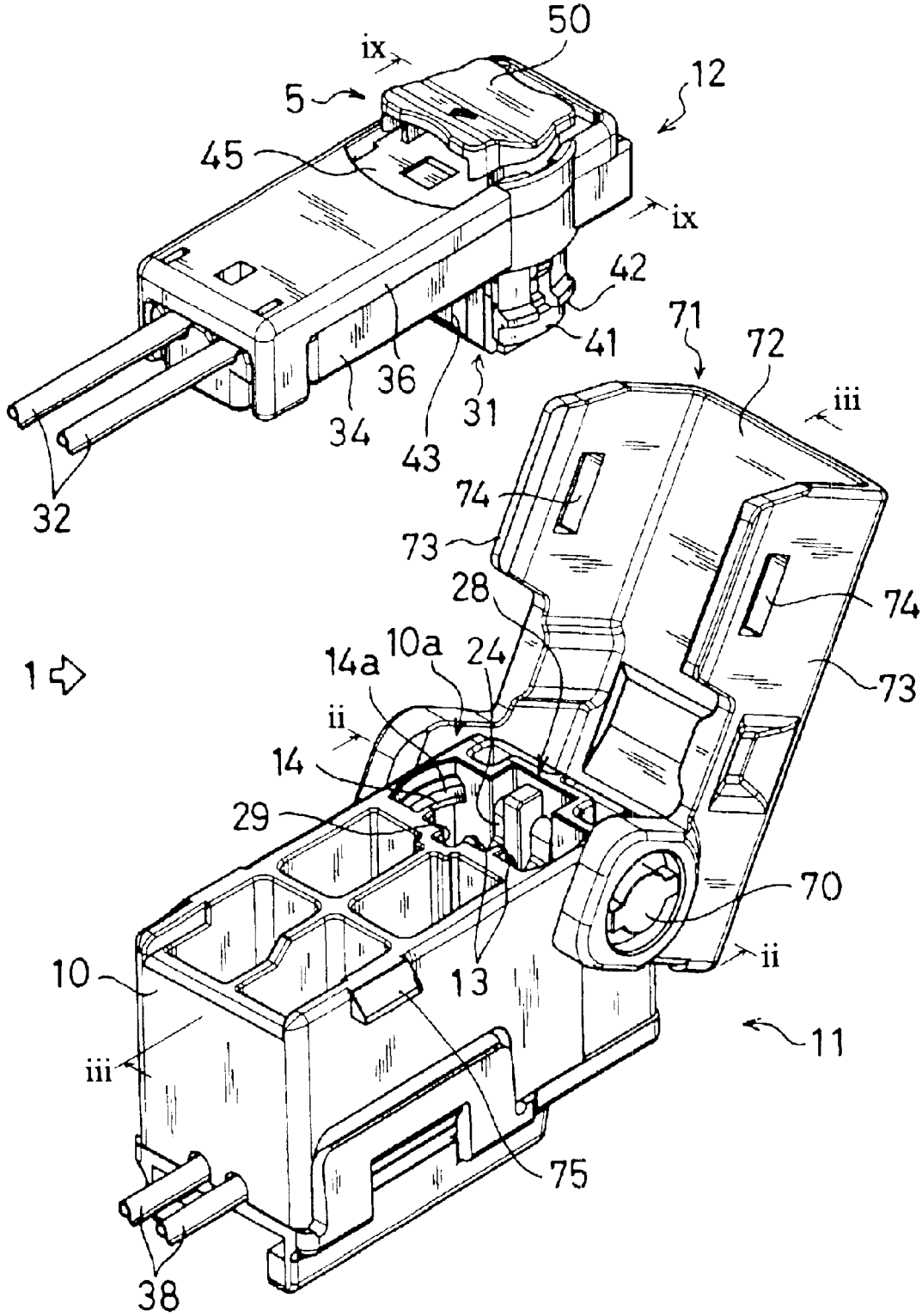
FIG. 1 is a perspective view of a general structure of an electrical connection system in accordance with an embodiment of the invention.

FIG. 1 illustrates a detailed general structure of a connector device (an electrical connection system) 11 used for an air bag system. The connection system 1 comprises a jack (a first component) 11 and a plug capable of engaging with the jack 11 (a second component) 12. FIG. 1 shows the jack 11 and the plug 12 before engagement.

The jack 11 is provided as a part of a repeater device intervening between a controller device of an air bag system and an igniter (referred to as a squib in some cases) of an air bag assembly, which should be electrically connected to the controller device. The igniter is a device that combusts when sufficient electrical energy is provided by a controlling system. Combustion of the igniter ignites gas-generating material, which opens an air bag.

The repeater device is used as a switch for switching an air bag between operation and non-operation in this embodiment. Turning the switch off intercepts an air bag operation signal from the controller device before it is received by the igniter, which prevents the air bag from being operated.

The above-mentioned jack 11 is provided with a shorting clip (a shorting element) 24. The shorting clip 24 shorts out a pair of two pins 13 provided in the jack 11 until the jack 11 is mechanically engaged with, and thereby, electrically connected to the plug 12. This will be later described in detail.

The plug 12 is to be electrically connected to the controller device of an air bag through two conductors 32. The plug 12 holds a latch unit (a latch element) 5 so that the latch unit 5 is latched at a first latch position shown in FIG. 1.

[Structure of the Jack]

As shown in FIG. 1, the jack 11 comprises a main body 10, which has an opening 10*a* formed in the top surface. The main body 10 may be directly built in an associated structure, such as a housing of the repeater device. Furthermore, the opening 10*a* may be formed as an individual element separated from the main body 10 to be added to the associated structure.

Figure 2:
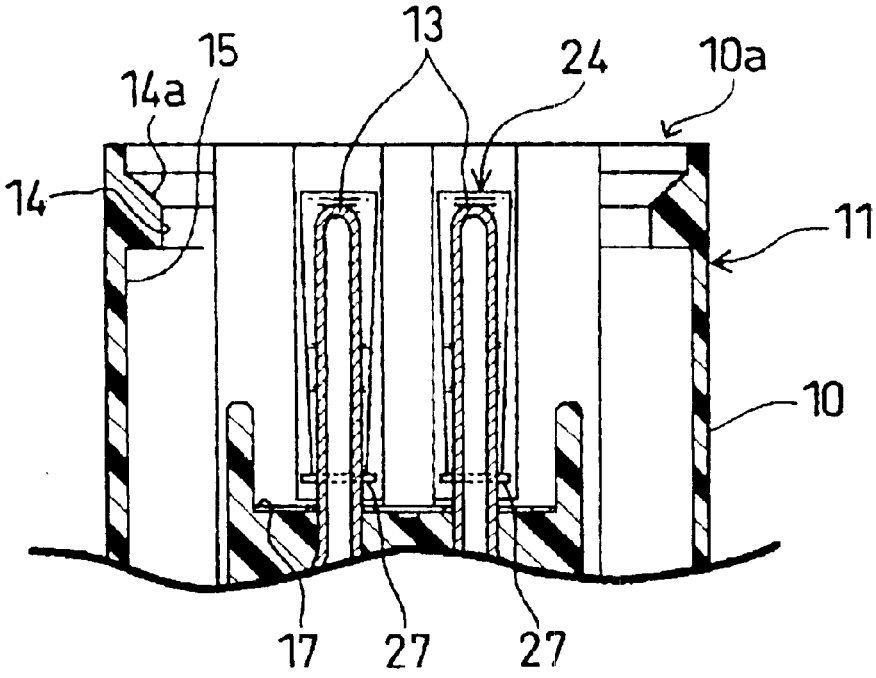
FIG. 2 is a sectional view taken along a line ii—ii shown in FIG. 1.
Figure 3:
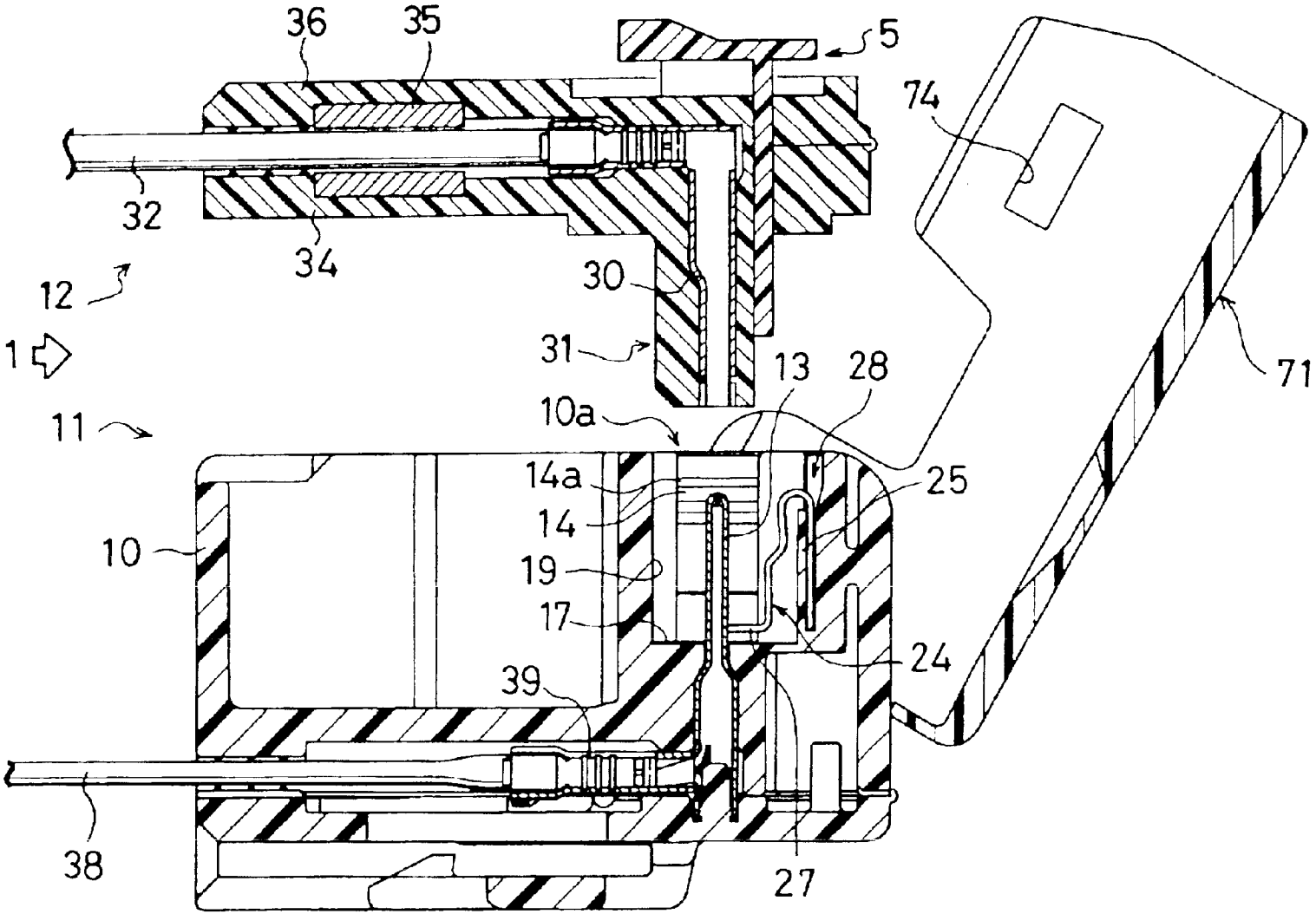
FIG. 3 is a sectional view taken along a line iii—iii shown in FIG. 1.

As shown in FIG. 2, which is a sectional view taken along a line ii—ii shown in FIG. 1, and in FIG. 3, which is a sectional view taken along a line iii—iii, the opening 10*a* of the main body 10 ends at a bottom wall 17. A pair of male pins (a first electrical connector element) 13, which has conductivity and made of metal, is upwardly projected from the bottom wall 17 (as shown in FIG. 3). At the respective roots of these two pins 13, a conductive connecting portion 39 is formed in a direction vertical to the root. The conductive connecting portion 39 is connected to one of the pair of conductors 38.

The conductors 38 are covered with insulation material, which is stripped at the end of the conductors 38 for the purpose of electrically and mechanically fitting the conductors 38 into the corresponding conductive connection portion 39. These conductors 38 may be mounted in any conventional manner (usually, by compressing a part of the conductive connecting portion 39 on the circumference of a naked end of the conductor 38).

The conductors 38 are connected in a known manner with a switch (not shown) for switching the air bag operation signal between repeating and intercepting. The switch is connected to an air bag igniter (not shown). Thus, when the switch turns on, giving electric energy to the pins 13 allows the igniter to be ignited to open the air bag.

As shown in FIG. 1, an inner wall of a side portion of the opening 10*a* is in the shape of an arc surface. The inner wall of a side portion of the opening 10*a* is provided at an entrance portion of the opening 10*a* with a convex portion 14 elongated in a circumferential direction. The top surface side of the convex portion 14 is slantingly cut to form a slant surface 14*a*.

Figure 11:
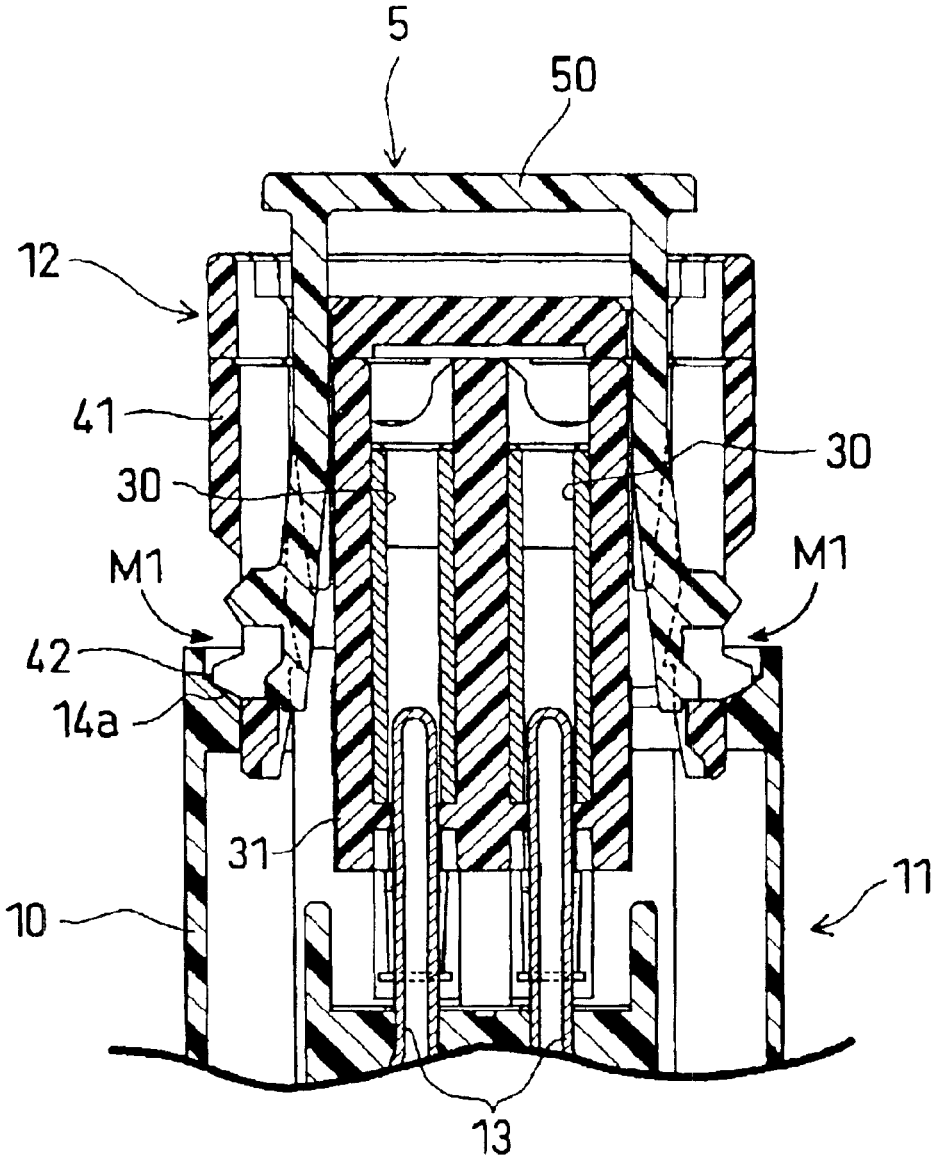
FIG. 11 is a sectional view taken along a line xi—xi shown in FIG. 10.
Figure 15:
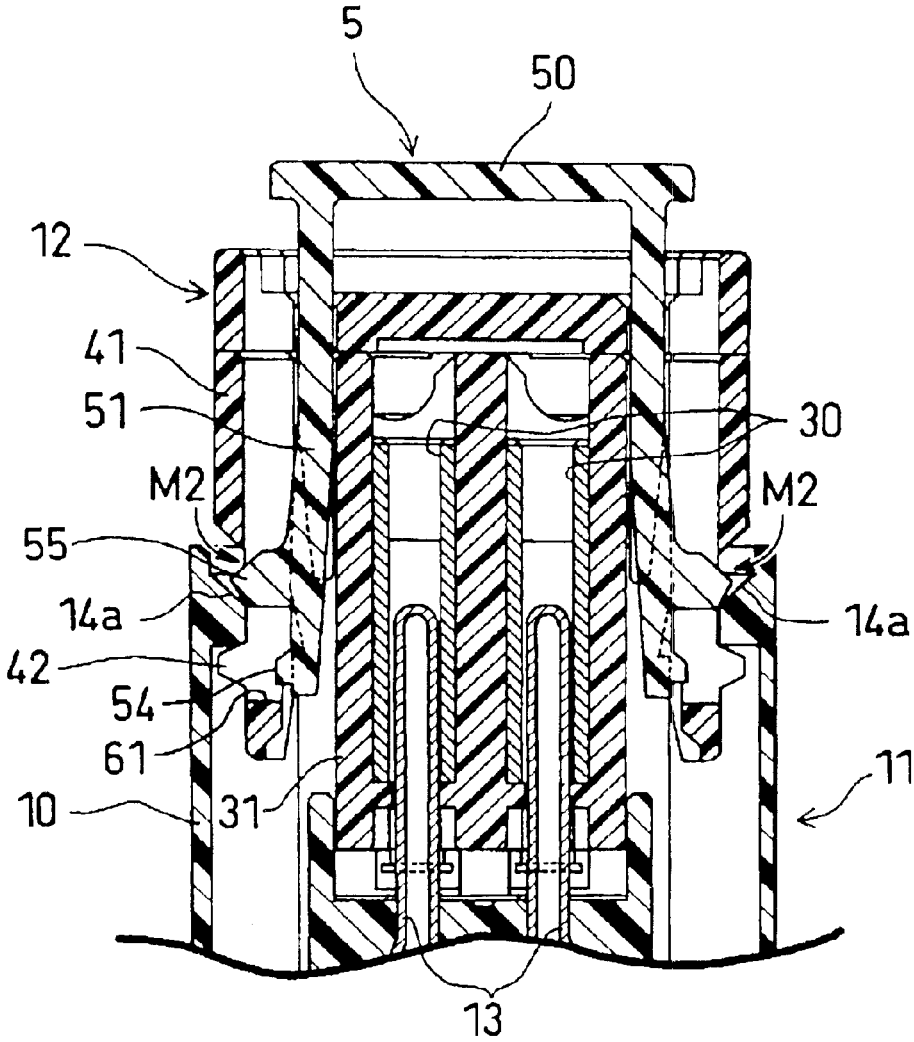
FIG. 15 is a sectional view taken along a line xv—xv shown in FIG. 14.
Figure 17:
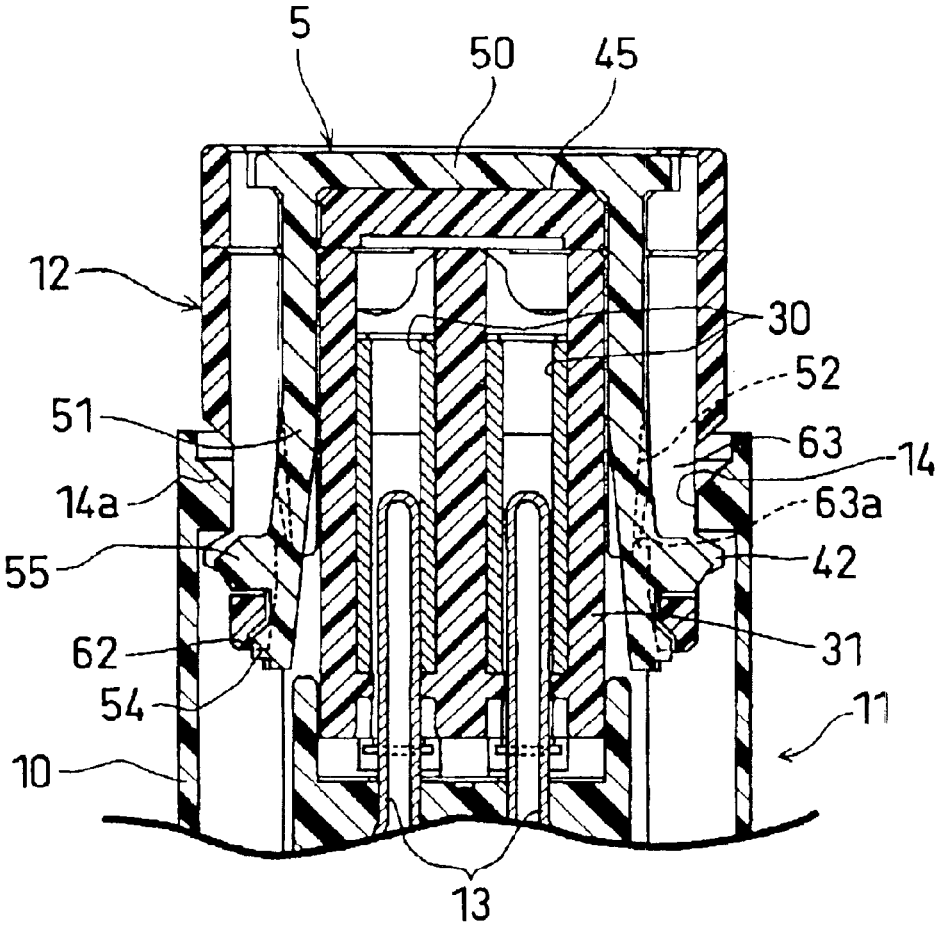
FIG. 17 is a sectional view taken along a line xvii—xvii shown in FIG. 16.

The slant surface 14*a* has a function of receiving a latch portion 42 or 55 of the plug 12 to cause a resilient leg 41 or first leg 51 to generate inward deformation moment, as shown best in FIGS. 11 and 15. The convex portion 14 has a function of engaging with, and thereby, locking the latch portion 42 of the latch unit 5 of the plug 12 to keep an engaging condition, as shown in FIG. 17. This will be later described in detail.

A shorting clip 24 is fixed in an inner wall of the above-mentioned opening 10*a*. The shorting clip 24 is formed from resilient conductive material such as spring steel. A part of the shorting clip 24 is leaned so as to abut both of the above pins 13 to form an electrically shorting circuit between the both pins 13.

Figure 4:
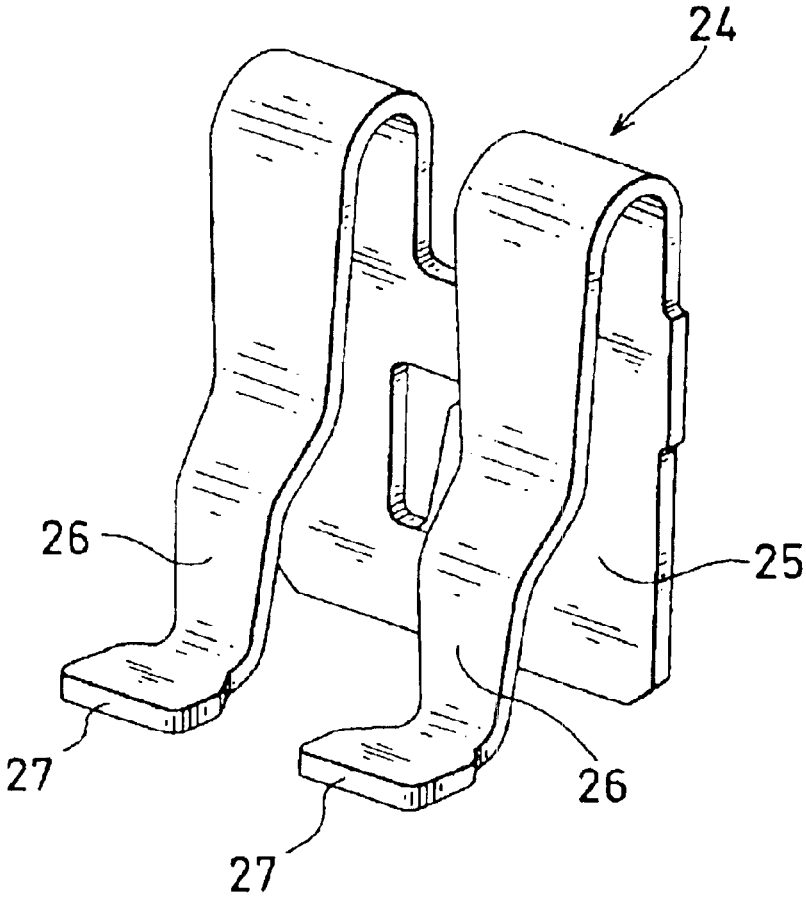
FIG. 4 is a perspective view of a shorting clip.

As shown best in FIG. 4, the shorting clip 24 comprises a plate base 25, a pair of legs 26, which bends at the top of the base 25 and extends downwardly, and a pair of abutting portions 27, which bends at an angle of 90 degrees under each of the above pair of legs 26. Each of the legs 26 is arranged to bend in the shape of steps in a direction separating from the base 25 and to lean so that the top of the abutting portions 27 abuts a side portion of the both pins 13 to be electrically connected. Inserting the base 25 into a slit-shaped concave 28 of the opening 10*a* formed in the main body 10 of the jack 11 so as not to come out, as shown in FIG. 3, allows the shorting clip 24 to be held in the opening 10*a*.

The shorting clip 24 is compressed and provided in the opening 10*a*, so that the abutting portions 27 is continuously urged in a direction separating from the base 25 (that is, a direction approaching the pins 13).

FIG. 3 shows a shorting clip 24 located at a shorting position. As shown in FIG. 3, a lower part of the two pins 13 contacts with the abutting portion 27 of the shorting clip 24 to be electrically connected, and the two pins extend upwardly in the opening 10*a*.

As shown in FIG. 1, the main body 10 of the jack 11 is formed into a generally rectangular shape. A rotating shaft 70 is projected to both sides, respectively, at an end in a longitudinal direction of the main body 10 (at the same end that the opening 10*a* is formed). A cover 71 (a rotating member) in the U-like shape is mounted to the rotating shaft 70 so as to be freely rotatable. The cover 71 comprises a head portion 72 and a pair of side wall portions 73 formed vertically from ends of the head portion 72. The side wall portion 73 is provided at a longitudinal end with a shaft hole, into which the above rotating shaft 70 is inserted, so that the cover 71 is freely rotatable about the rotating shaft 70, which allows the cover 71 to open and close. FIGS. 1 and 3 show a condition in which the cover 71 is open.

The side wall portions 73 are respectively provided with a locking aperture 74 whose dimension and location are arranged to be able to engage with a projection 75 (a fixing unit) projectingly formed in a side outer wall of the main body 10. Thus, the locking aperture 74 is engaged with the projection 75 when the cover 71 is closed, so that the cover 71 can be kept closed.

[Structure of the Plug]

The plug 12 of the connector device 1 can be further understood by referring to FIGS. 1 and 3. The plug 12 comprises a center plug portion (a main body portion) 31, which holds inside a pair of female electrical terminals (a second electrical connector element) 30 extending downwardly, as shown in FIG. 3. Structure and dimension of these electrical terminals 30 are arranged so that the electrical terminals 30 can be electrically connected to the conductors 32 and receive the pins 13 of the above jack 11 to be able to engage with them. In connecting the electrical terminals 30 to the conductors 32, a known method, such as compression, can be adopted as in the case of connection between the pins 13 and the conductors 38.

Figure 5:
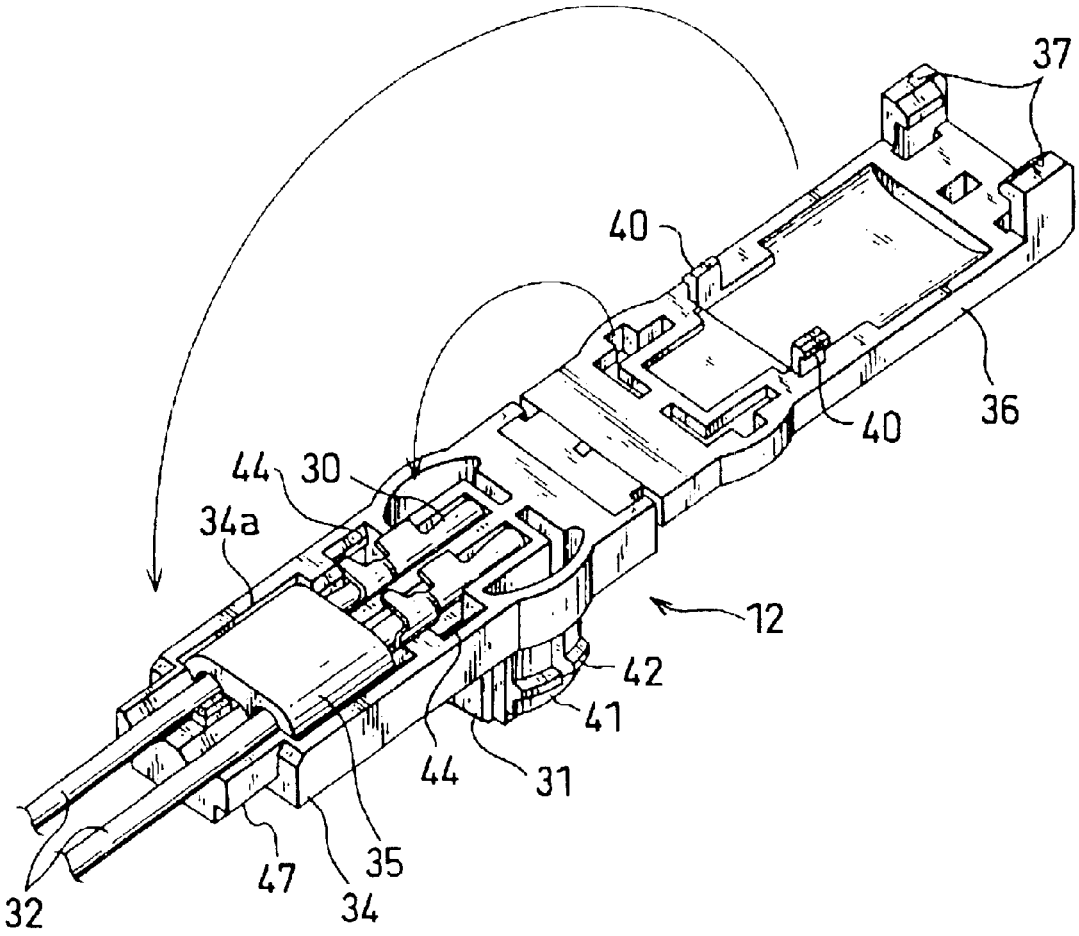
FIG. 5 is a perspective view showing an inner part of a plug.

The conductors 32 pass through a ferrite bead 35 provided in a space 34*a* of a box-shaped lower side portion 34 of the plug 12, as shown in FIG. 5. The ferrite bead 35 is a generally box-shaped homogeneous substance and provided with two cylindrical through-holes in parallel. Inserting the conductors 32 into the through-holes allows noise generated in the conductors 32 to be eliminated. The conductors 32 pass through an opening portion of a rear wall of the space 34*a*, and then, go outside from an end-of the lower side portion to be connected with the controller device.

Figure 6:
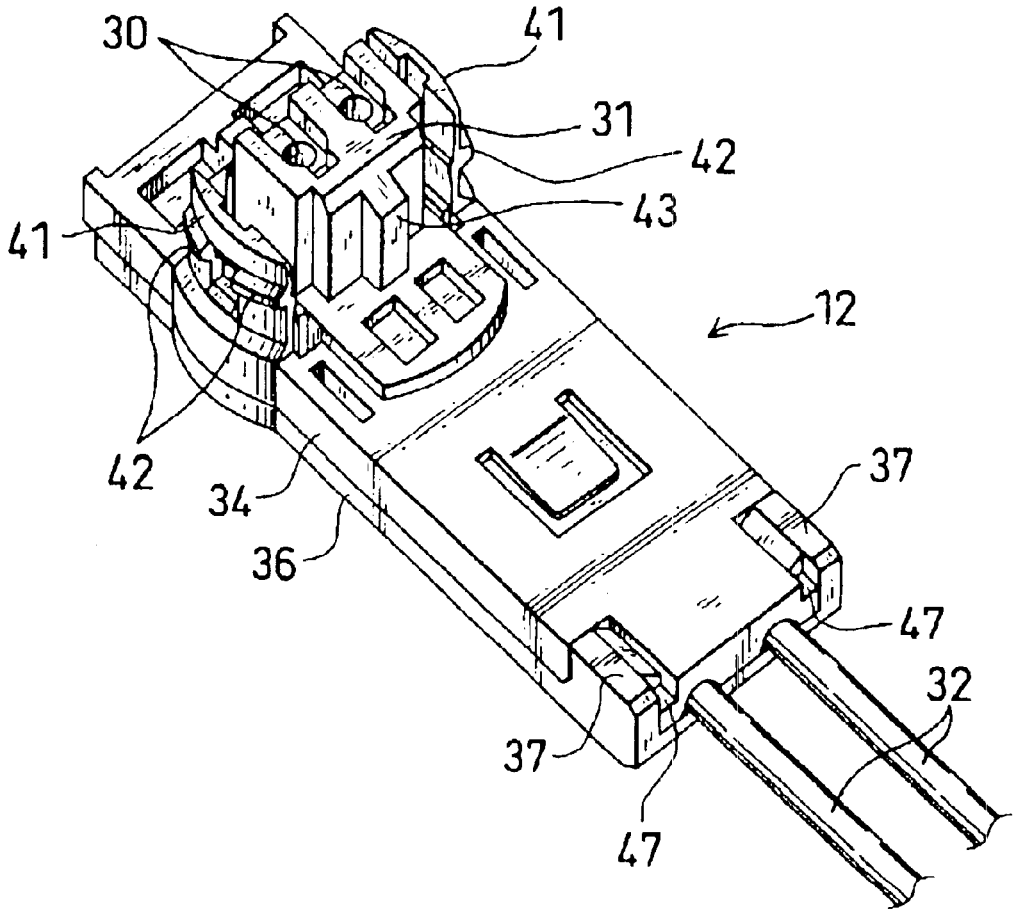
FIG. 6 is a perspective view of a plug in which a center plug part is faced upwardly.

As shown best in FIG. 6, the center plug portion 31 has a generally quadratic cylinder shape. A pair of arc-shaped resilient legs 41 is provided on the sides of the center plug portion 31 to extend downwardly in parallel to the center plug portion 31 (the upper part of the sheet in FIG. 6 shows the lower part). Dimension and location of the resilient legs 41 are determined so as to be able to tightly engage with the inside of the opening 10*a* of the main body 10 of the jack 11.

At the lower part of the resilient legs 41, formed latch portions 42 projecting outward in its radial direction. Dimension and location of the latch portions 42 are arranged to be able to enter an under space over the above-mentioned convex portion 14 when the plug 12 is properly engaged with the jack 11, as shown best in FIG. 15.

The center plug portion 31 further includes a convex 43, as shown in FIGS. 1 and 6. Dimension and location of the convex 43 are arranged to be able to engage with a concavity 29 (shown in FIG. 1), which is formed in an inside wall of the opening 10*a*, when the plug 12 is connected to the jack 11 in a proper direction. The convex 43 and the concavity 29 prevent connection from being in a wrong direction, so that a correct connecting relation can be secured between the two electrical terminals 30 of the plug 12 and the two pins 13 of the jack 11.

As shown in FIG. 5, the plug 12 is formed into one body so that a longitudinal end of the upper side portion 36 can be connected to the lower side portion 34. The connecting part is deformable and arranged so that the above upper side portion (a cover portion) 36 can be folded back in a direction shown in an arrow in FIG. 5. The above-mentioned center plug portion 31 and the resilient legs 41 are formed in the lower side portion 34.

In the upper side portion 36, a pair of tub extensions 37 and a pair of latch portions 40 are formed, both of which can be resiliently deformed. On the other hand, engaging grooves 47 and locking apertures 44 are formed in the lower side portion 34. In such a structure, the upper side portion 36 is folded back so that the above-mentioned conductors 32 and the ferrite bead 35 are sandwiched between the upper and lower side portions 36 and 34, the tub extensions 37 are engaged with the engaging grooves 47, and the latch portions 40 are engaged with the locking apertures 44. The upper side portion 36 and the lower side portion 34 are thus united. Accordingly, a generally rectangular enclosure covering the conductors 32 is provided.

Figure 7:
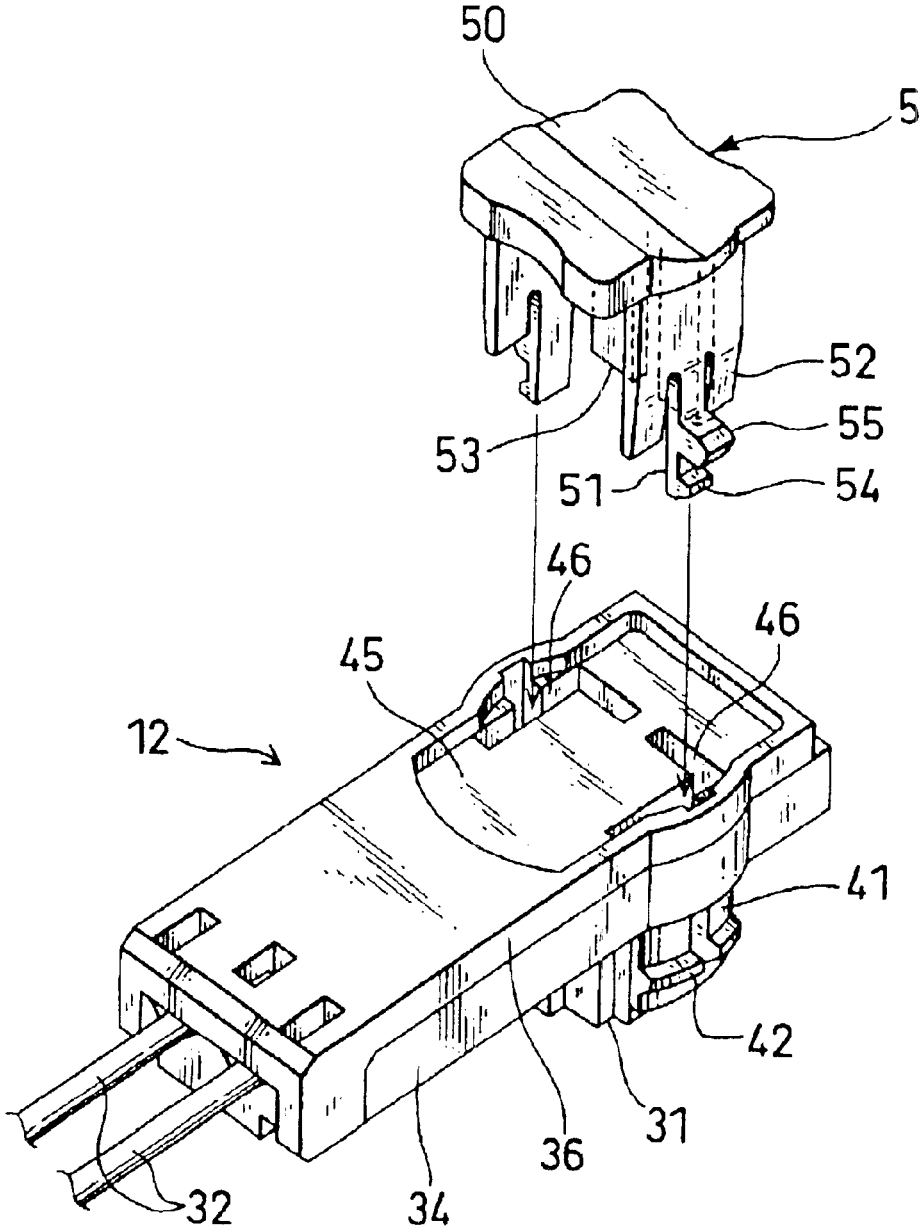
FIG. 7 is a perspective view showing how to mount a latch unit to a plug.

As shown best in FIG. 7, a wide and shallow concave 45 is formed in an upper surface of the upper side portion 36 of the plug 12 in a location corresponding to a place that the center plug portion 31 is formed. On the both sides in a width direction of the concave 45, a pair of generally L-shaped through openings 46 is formed with the openings 46 facing each other.

Figure 8:
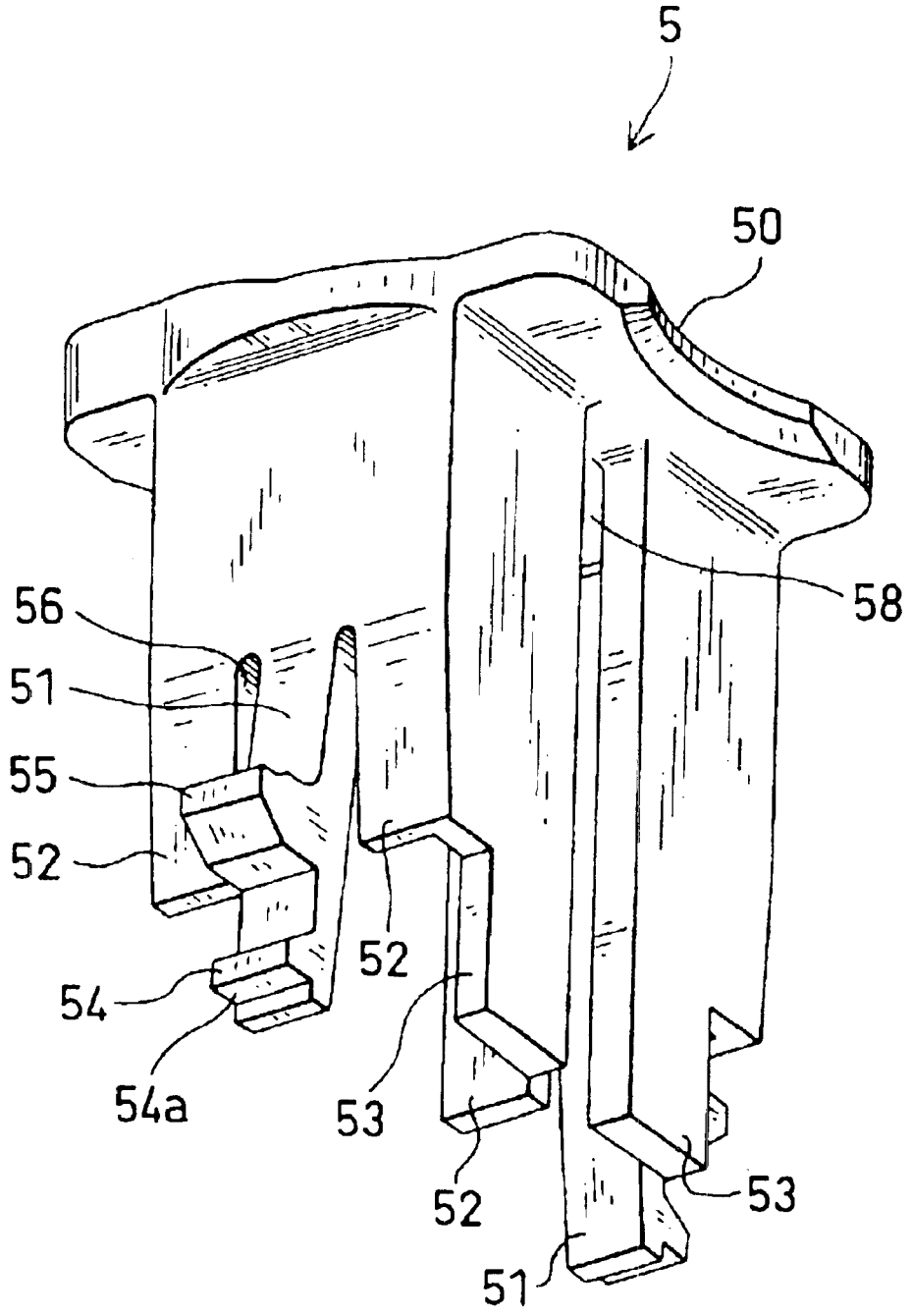
FIG. 8 is a detailed perspective view of a structure of a latch unit.

A latch unit (a latch element) 5 described hereinafter is mounted on the through openings 46. As shown in FIGS. 7 and 8, the latch unit 5 comprises a head portion (a pressing portion) 50, a pair of first legs 51 downwardly extending from the both sides in a width direction of the head portion 50, a restricting portions 52 located on both sides of the first legs 51, which sandwiches the first legs 51, and a pair of second legs 53 downwardly extending from a longitudinal end of the pressing portion 50 in line. The first legs 51 and the restricting portions 52 are formed in line while the second legs 53 are provided vertically in relation to the first legs 51 and the restricting portion 52 so that the second legs 53 are faced each other via a slit 58.

Dimension and location of the legs 51 and 53 and restricting portions 52 are arranged to be able to be inserted into the generally L-shaped through openings 46 formed in the upper side portion 36 of the above plug 12.

The above first legs 51 comprise a first latch portion 54 and a second latch portion 55 in order from the bottom part. Both of the latch portions 54 and 55 are provided so as to project outward. The second latch portion 55 projects more than the first latch portion 54.

The latch unit 5 will be concretely described in detail, made with reference to FIG. 8, mainly. On a top end of the first latch portion (a small projecting portion) 54 of the first leg 51, there is formed a step portion 54*a*. As shown best in the left-hand part of FIG. 9, which is a sectional view taken along a line ix—ix in FIG. 1, the resilient leg 41 of the plug 12 is provided with a lateral opening 60, at a lower end of which a step portion 61 is formed.

The latch unit 5 is latched at a position where the step portion 54*a* of the first leg 51 comes into contact with the step portion 61 of the resilient leg 41 (referred to as "a first latch position") when the latch unit 5 is inserted into the plug 12 to be mounted. In this condition, the second latch portion (a large projecting portion) 55 of the latch unit 5 projects outward from the opening 60 to be able to operate.

Inside the lower end of the resilient leg 41, a latch groove 62 is formed so that the resilient leg 41 is hollow in its radial direction. When the latch unit 5 moves downwardly from the above-mentioned first latch position, an outward projecting portion of the first latch portion 54 is latched in the latch groove 62. This position is referred to as "a second latch position." Latch strength at the second latch position is a little bit weak such that the position can get back to the first latch position when the latch unit 5 is pulled up from the plug 12.

Figure 9:
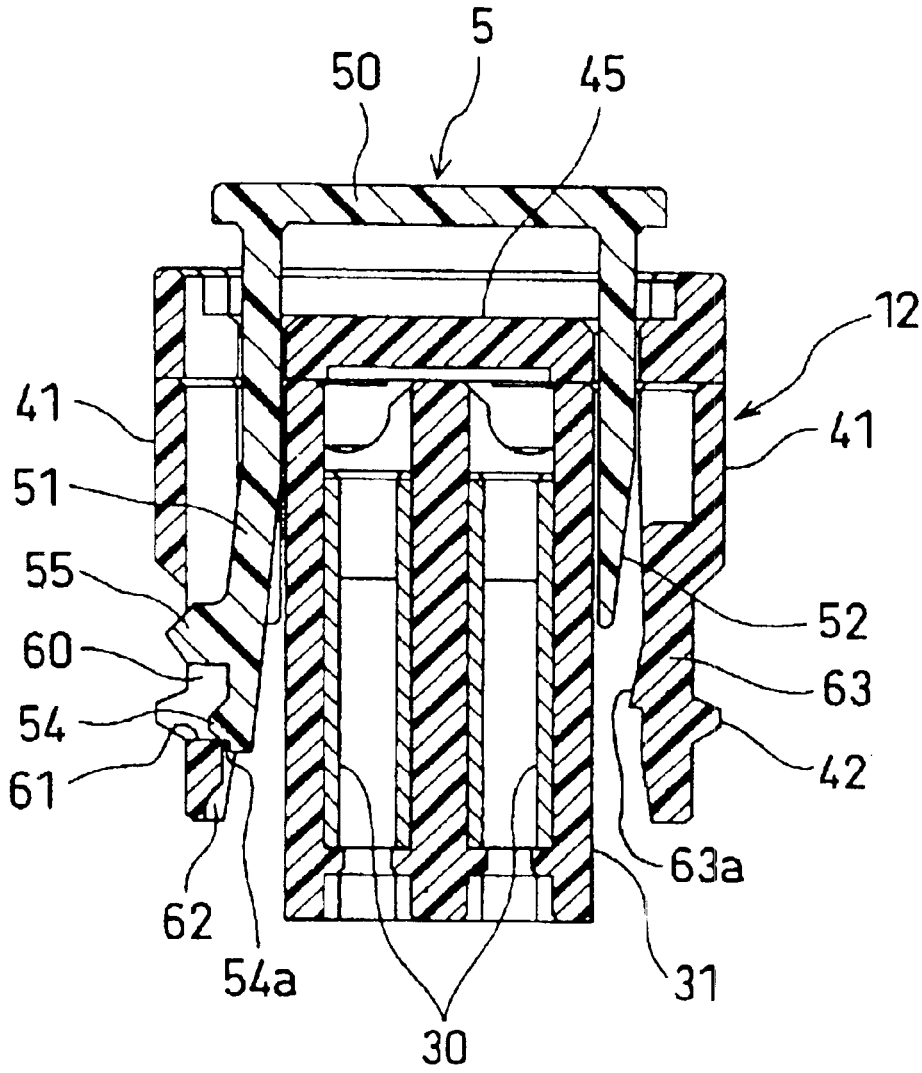
FIG. 9 is a sectional view taken along a line ix—ix shown in FIG. 1.

As shown in FIG. 8, the restricting portions 52 of the latch unit 5 are provided through slits 56 so as not to disturb resilient deformation of the first legs 51 and the restricting portions 52 extend downwardly. The restricting portion 52 is downwardly tapered, as shown in FIG. 9. As shown best in the right-hand part of FIG. 9, the restricting portion 52 is located between an inward protruded portion 63*a* formed on an inner surface of a wall-thickness portion 63 of the resilient leg 41 of the plug 12 and an outer surface of the side portion of the center plug portion 31.

When the latch unit 5 is at the first latch position shown in FIG. 9 (that is to say, when the head portion 50 is suspended so as to be separated from the concave 45 of the plug 12), the above restricting portion 52 is located so as to be upwardly kept away from the inward protruded portion 63*a* of the wall-thickness portion 63 of the resilient leg 41. Therefore, the latch portion 42 of the resilient leg 41 are not restricted to being inwardly deformed. On the other hand, the restricting portion 52 comes down to a position that it faces to the inward protruded portion 63*a* when the latch unit 5 is at the second latch position (that is to say, when the head portion 50 is contained in the concave 45), so that inward and resilient deformation of the resilient leg 41 is prevented.

Figure 16:
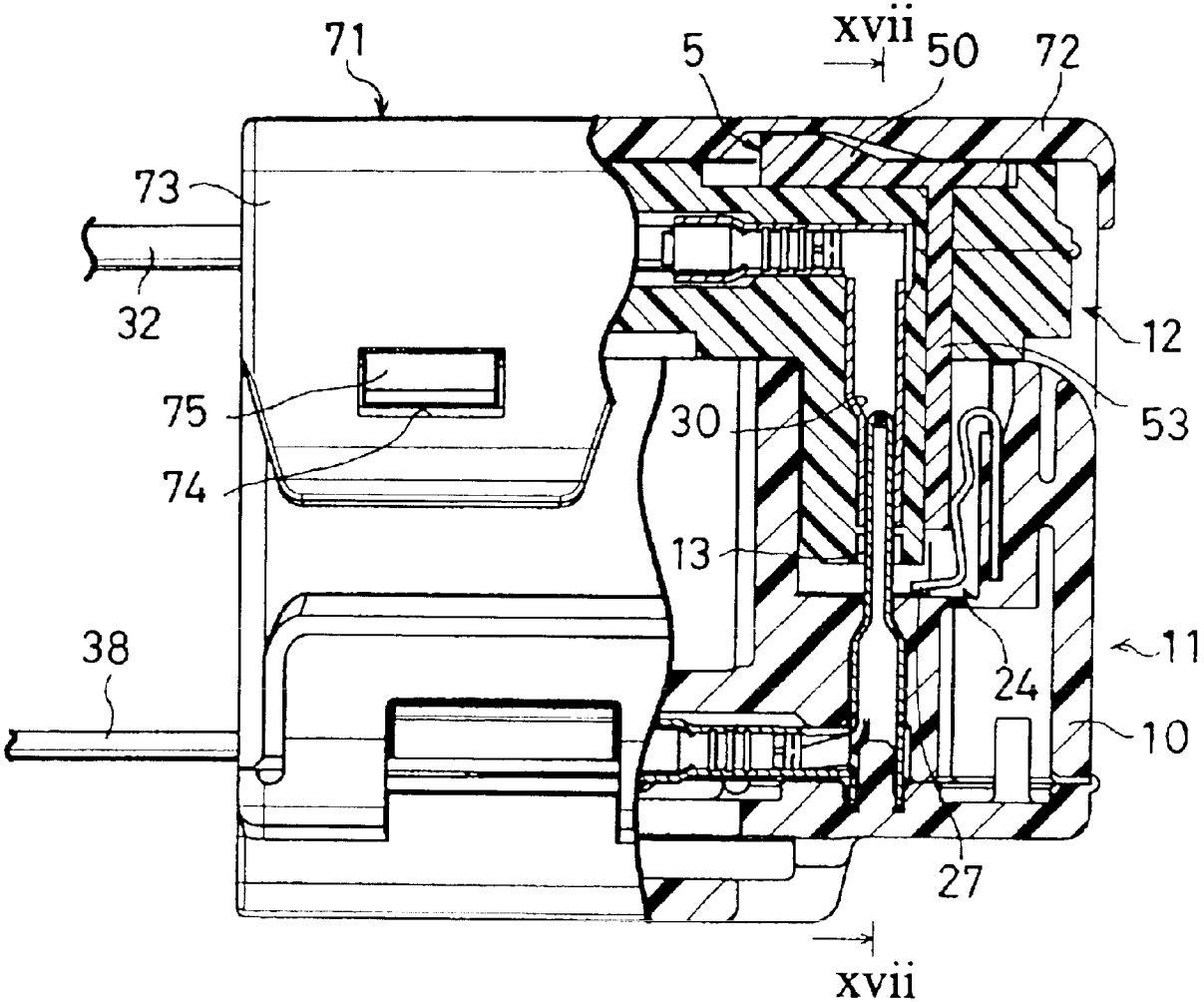
FIG. 16 is a side sectional view showing a condition in which a cover is closed and locked.

As shown best in FIG. 16, when the latch unit 5 is pushed from the first latch position to the second latch position, the second legs 53 move to a bending part of the shorting clip 24 to separate the abutting portions 27 from the pins 13 so as to cancel electrical shorting of the pins 13. It is possible to arrange that any one of legs 53 only separates the abutting portion 27 from the pin 13 although both legs of a pair of the second legs 53 move to the bending part of the shorting clip 24 in the above structure.

[Connecting Operation]

The way of connecting the connector device (electrical connection system) 1 described above will be described, made with reference primarily to the drawings after FIG. 10.

As shown in FIG. 3, the above-mentioned shorting clip 24 provided in the opening 10*a* of the jack 11 electrically shorts out the pins 13 when the jack 11 is not connected to the plug 12. The cover 71 on the jack 11 side is open as shown in FIGS. 1 and 3. The latch unit 5 mounted to the plug 12 is latched in advance at the above-mentioned first latch position (a position where the step portion 54*a* of the first leg 51 comes into contact with the step portion 61 of the resilient leg 41) as shown in FIG. 9.

In the case that the plug 12 is separated from the jack 11 (that is, in the case shown in FIGS. 1, 3 and 9), the latch unit 5 is not pushed into the plug 12 due to interaction between the above-mentioned steps 54*a* and 61 even when the latch unit 5 is depressed toward the plug 12. Thus, the head portion 50 of the latch unit 5 is suspended from the concave 45 of the plug 12. Such condition can be checked by looking, as shown in FIG. 1.

Figure 10:
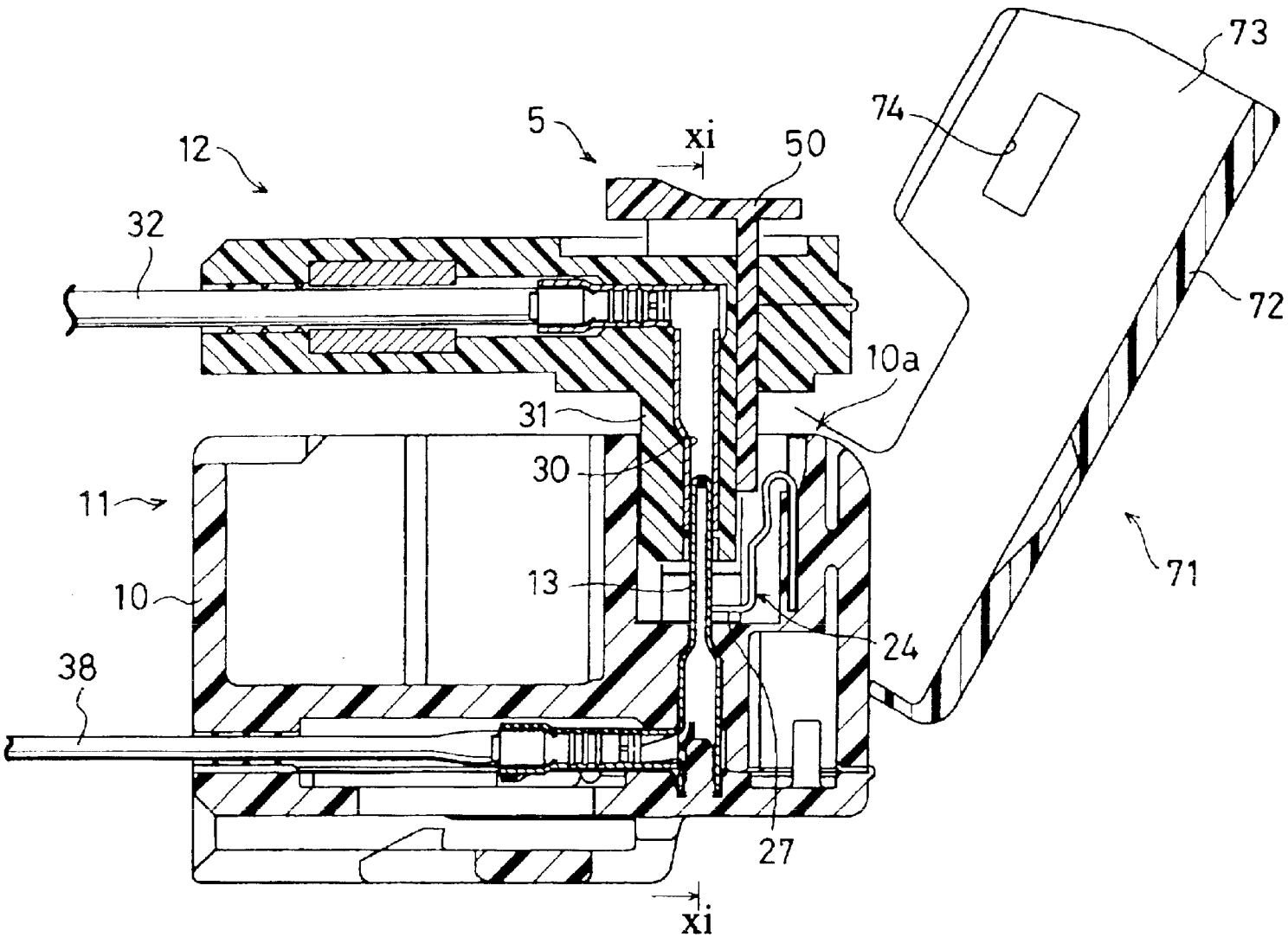
FIG. 10 is a side sectional view showing a condition in which a part of a plug is inserted into a jack.

FIGS. 10 and 11 show a condition that, after the above condition, the side surfaces of the upper and lower portions 36 and 34 of the plug 12 are held with fingers so that the center plug portion 31 and a part of the lower end of the resilient leg 41 would be inserted into the opening 10*a* of the jack 11. In this condition, the latch portion 42 of the resilient leg 41 is stationary in contact with the slant surface 14*a* at an entrance of the opening 10*a*, as shown in FIG. 11.

Figure 12:
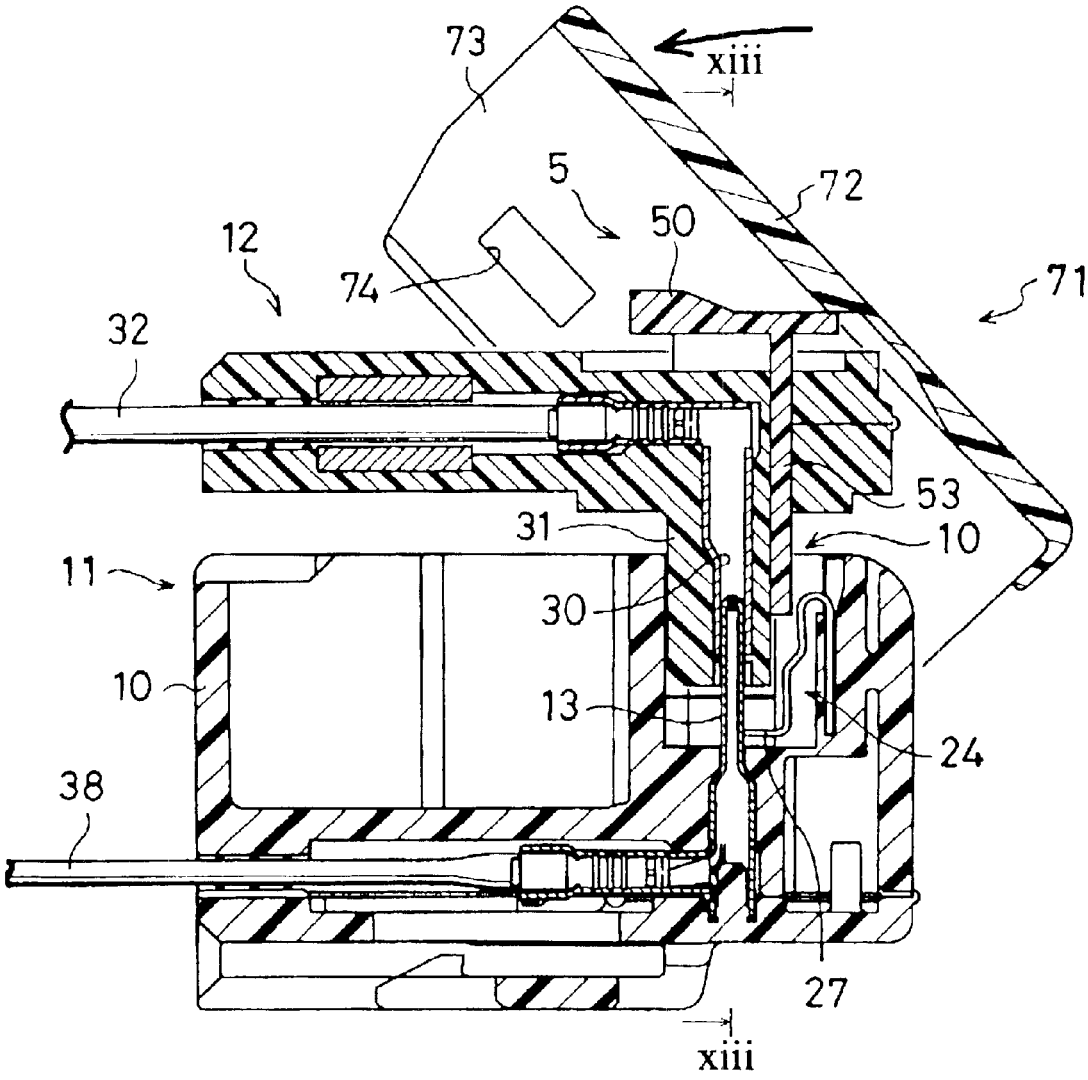
FIG. 12 is a side sectional view showing a condition in which a rotated cover pushes a plug.

When the cover 71 is rotated in a closing direction, a lower surface of the head portion 72 (a head surface) of the cover 71 pushes down the head portion 50 of the latch unit 5, as shown in FIG. 12. The cover 71 is held on its one longitudinal end by the rotating shaft 70 so as to be freely rotatable and is arranged so that a longitudinally middle part of the head portion 72 would push the latch unit 5. Thus, adding force on the longitudinal other end side of the upper surface of the head portion 72 to close the cover 71 allows the latch unit 5 to be strongly pushed down with small force in accordance with leverage created by using the rotating shaft 70 as a fulcrum. As a result, an assembling operation can be made easy, which reduces the fatigue of an assembling operator.

Pushing down the step portion 54*a* of the latch unit 5 (as shown in FIG. 9) further pushes the step portion 61 of the resilient leg 41 downwardly. Accordingly, downward force operates on the whole plug 12. This causes the latch portion 42 of the resilient leg 41 to slide on the slant surface 14*a*, so that moment M1 (shown in FIG. 11) toward the inner side operates on the resilient leg 41.

Figure 13:
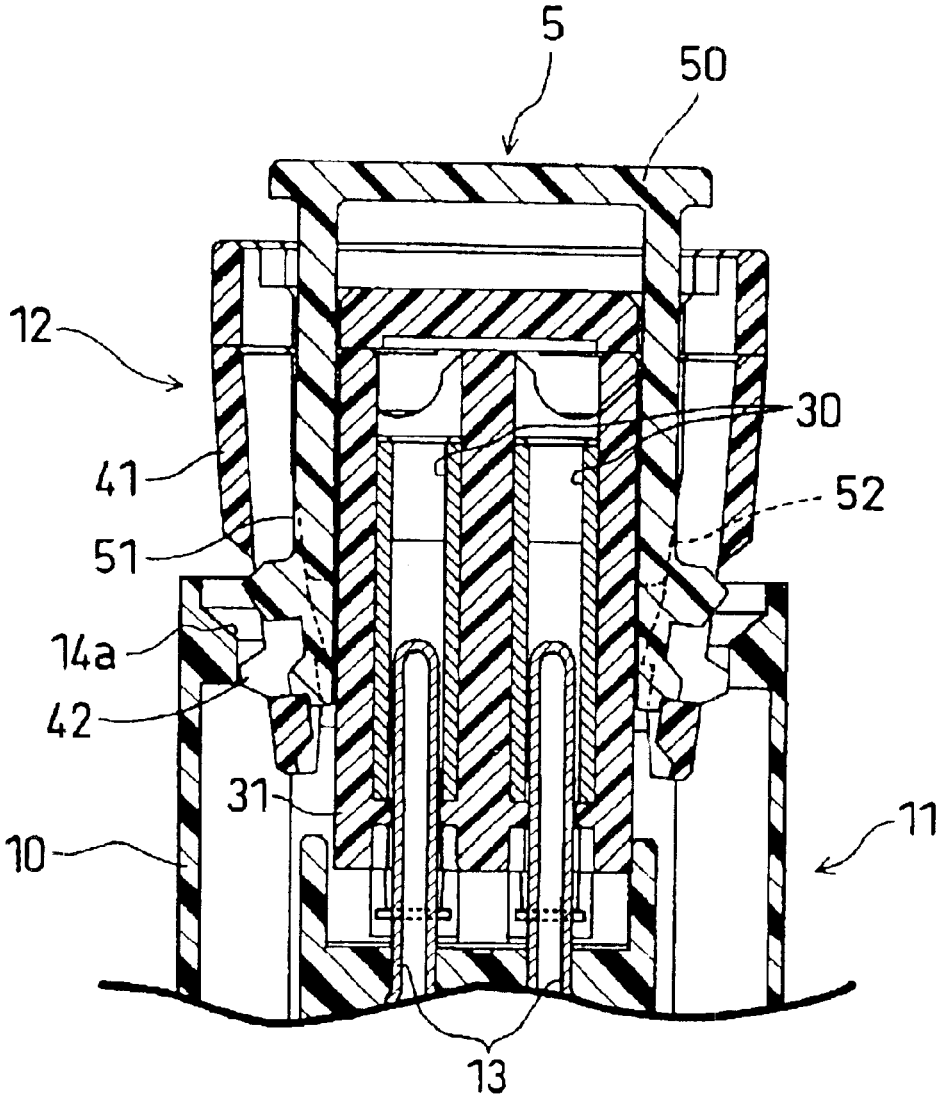
FIG. 13 is a sectional view taken along a line xiii—xiii shown in FIG. 12.
Figure 14:
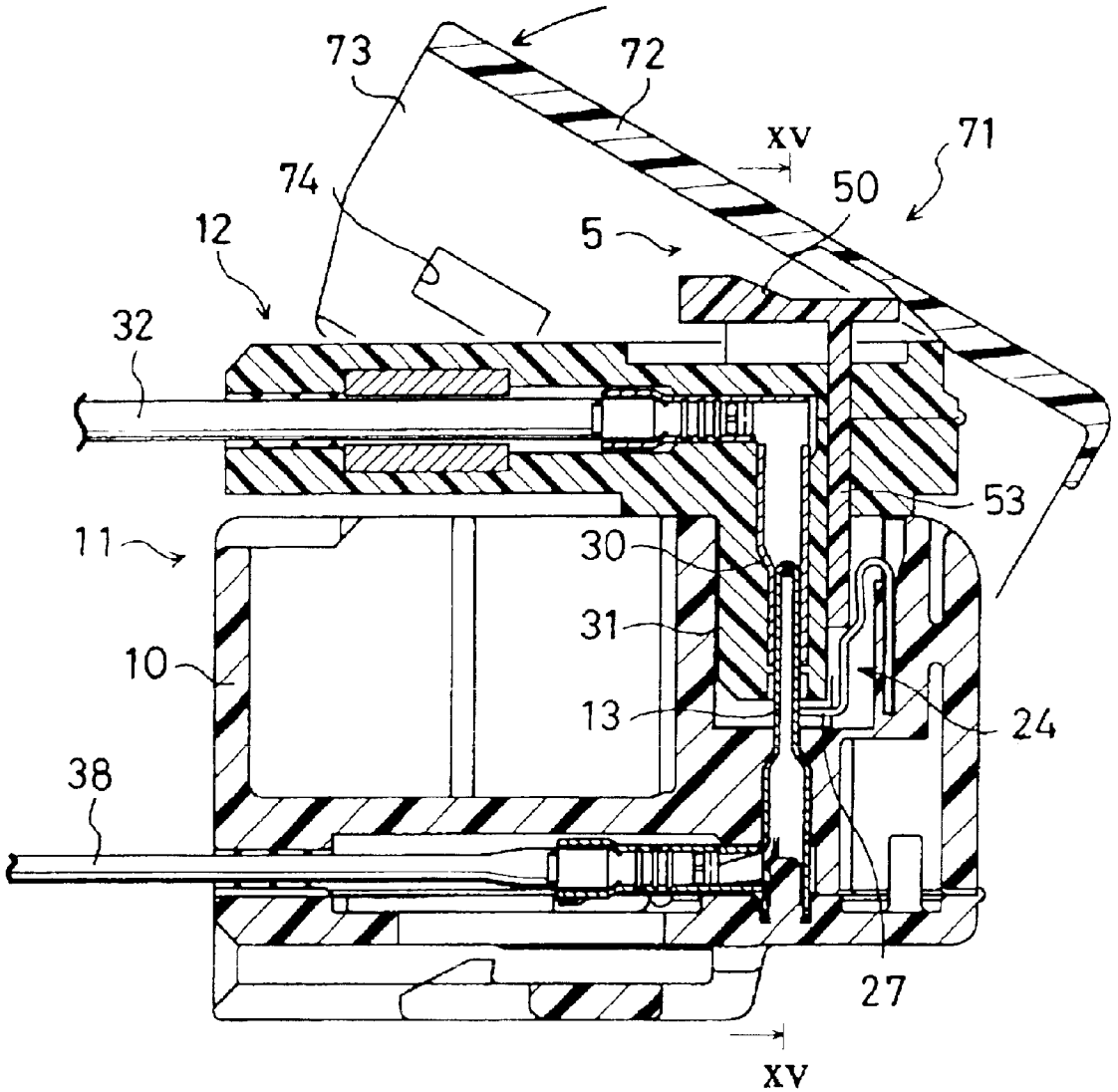
FIG. 14 is a side sectional view showing a condition in which a cover further pushes a latch unit.

The restricting portion 52 is not at a position of the inward protruded portion 63*a* of the resilient leg 41 since the latch unit 5 is at the first latch position as described above, so that inward deformation of the resilient leg 41 is not restricted. Accordingly, the resilient leg 41, on which the above-mentioned moment M1 operates, bends inwardly as shown in FIG. 13, and the latch portion 42 moves downwardly over the convex portion 14. FIGS. 14 and 15 show a condition after the latch portion 42 has been moved. As clearly seen from FIGS. 14 and 15, the pins 13 on the jack 11 side are electrically conductive with the electrical terminals 30 on the plug 12 side.

After the latch portion 42 moves over the convex portion 14, the second latch portion 55 of the latch unit 5 is located on the slant surface 14*a* at an entrance of the opening 10*a*, as shown in FIG. 15. Under such condition, when the cover 71 is further rotated in a direction shown by an arrow in FIG. 14 to further push down the head portion 50 of the latch unit 5, the second latch portion 55 slides on the slant surface 14*a*, so that moment M2 (shown in FIG. 15) toward the inner side operates on the first leg 51 of the latch unit 5. As a result, the first leg 51 bends inwardly, the second latch portion 55 moves downwardly over the convex portion 14, and the latch unit 5 moves downwardly in relation to the plug 12, so that the head portion 50 of the latch unit 5 is held in the concave 45 in a top surface of the plug 12.

The latch unit 5 is thus located at the second latch position, at which the second latch portion 55 of the first leg 51 is located under the convex portion 14 and the first latch portion 54 of the first leg 51 is latched in the latch groove 62.

Figure 18:
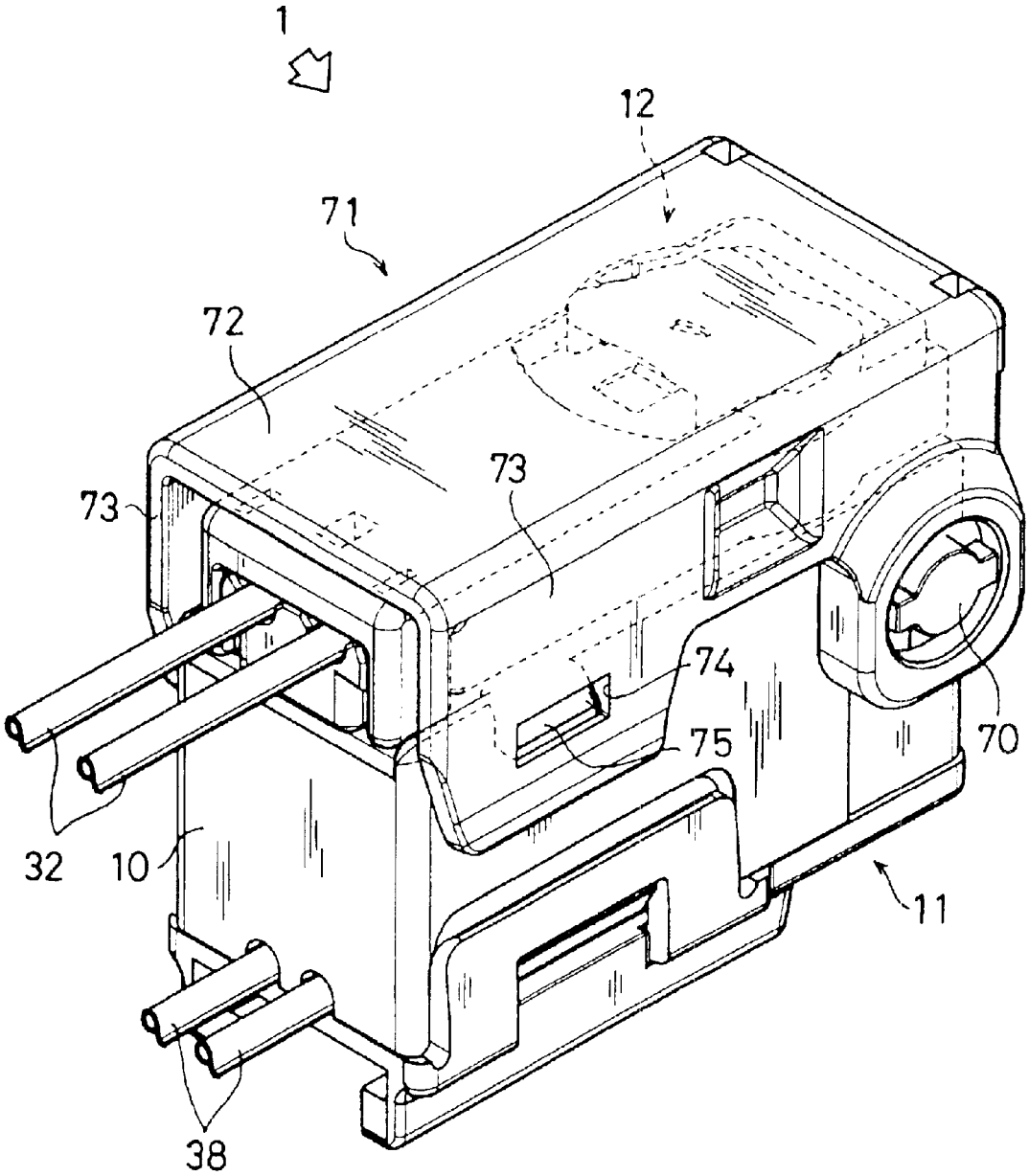
FIG. 18 is a perspective view showing a condition in which a cover is closed and locked.

At the same time, the cover 71 is closed so as to veil over the plug 12 and the locking aperture 74 formed in the side wall portion 73 of the cover 71 engages with the projection 75 projecting from the side surface of the main body 10. Thus, the cover 71 is fixed in a closed condition as shown in FIGS. 16 and 18. The cover 71 is then not rotated accidentally, which prevents disruption of subsequent operations.

When the latch unit 5 is in the second latch position, the second leg 53 also moves downwardly and the lower end of the second leg 53 pushes a step-shaped portion of the shorting clip 24 so as to separate the abutting portion 27 from the pin 13. Electrically shorting the pins 13 is then canceled. Accordingly, electrical connection between the pair of pins 13 and the electrical terminals 30 is completed.

As shown in FIG. 17, in the case of the second latch position, the restricting portion 52 of the latch unit 5 is sunk to a position facing to the inward protruded portion 63*a* provided on an inner surface of the wall-thickness portion 63 of the resilient leg 41, so that inward and resilient deformation of the resilient leg 41 is interrupted. Thus, the latch portion 42 of the resilient leg 41 cannot move over the convex portion 14 even when upward force is added to the plug 12, and therefore, the plug 12 cannot come out from the jack 11.

That is to say, the plug 12 cannot come out from the jack 11 so long as the latch unit 5 is pulled up again to be at the first latch position. This means that mechanical locking is achieved while the plug 12 and the jack 11 are connected.

The connecting operation has been described herein in a step by step process. Rotation of the cover 71 is successively carried out in order from FIG. 10 to FIGS. 12, 14 and 16, in practice. That is to say, only one operation of rotating the cover 71 allows engagement of the plug 12 with the jack 11 and movement of the latch unit 5 to the second latch position to be successively performed in a short time.

The above can be achieved when:

(A) both of directions that the plug 12 is engaged with the jack 11 and that the latch unit 5 is moved from the first latch position to the second latch position are same and downward;

(B) the rotating cover 71 is arranged to push the latch unit 5 downwardly by rotating in a closing direction;

(C) in the case that the latch unit 5 is at the first latch position, the latch unit 5 and the plug 12 are latched so that the force that the cover 71 pushes downwardly the latch unit 5 would be utilized as pushing force of the whole plug 12; and (D) after completing engagement of the plug 12 with the jack 11, latching between the latch unit 5 and the plug 12 is canceled and the force that the cover 71 pushes downwardly the latch unit 5 is utilized as the force that the latch unit 5 moves to the second latch position.

Therefore, only one operation (one action) of rotating the cover 71 can carry out two operations: (1) engagement of the plug 12 with the jack 11; and (2) movement of the latch unit 5 to the second latch position, in a short time, so that time and trouble in an assembling operation would be reduced.

Furthermore, as clearly shown in FIG. 16, dimension and shape of the cover 71, the plug 12 and the latch unit 5 are determined so that the plug 12 would be engaged with the jack 11 and the latch unit 5 would be necessarily at the second latch position when the cover 71 is in a closed condition and is fixed by engagement between the locking aperture 74 and the projection 75.

Therefore, only looking whether the cover 71 is in a closed condition or not can check that the jack 11 is properly engaged with the plug 12 and that the latch unit 5 is at the second latch position. It is easier to check than looking whether the small latch unit 5 is at the second latch position or not, so that a mistake of forgetting to latch the latch unit 5 in an operation of assembling an air bag would be significantly reduced.

Moreover, when the cover 71 is in a closed condition and is fixed by engagement between the locking aperture 74 and the projection 75, the head surface 72 of the cover 71 restricts both the coming-out of the plug 12 from the jack 11 and upward movement of the latch unit 5 in relation to the plug 12 (movement to the first latch position). This means that double locking by means of the latch unit 5 and the cover 71 is possible so that engagement between the jack 11 and the plug 12 would not be canceled. Thus, the plug 12 can be surely prevented from naturally coming out from the jack 11 accidentally.

In the closed condition, the cover 71 veils in a U-like shape the upper and side surfaces of the plug 12 connected to the jack 11, as shown in FIG. 18, so that an engaged part between the jack 11 and the plug 12 can be protected against shock. Therefore, stability of electrical connection between the jack 11 and the plug 12 can be secured.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An electrical connection system used for an air bag system, comprising:

a first component holding a pair of first electrical connector elements;

a second component holding a pair of second electrical connector elements respectively engaged with the first electrical connector elements;

a shorting element mounted to the first component for electrically shorting the first electrical connector elements together;

a latch element mounted to the second component, the latch element being capable of moving between a first position for shorting the first electrical connector elements by means of the shorting element and a second position for moving the shorting element to a non-shorting position;

a rotating member provided on the first component so as to be freely rotatable, rotation of the rotating member making the second component engage with the first component and making the latch element move to the second position; and a fixing unit for fixing the rotating member on the first component;

wherein movement of the latch element to the second position is limited when the second component is not engaged with the first component, wherein a direction that the second component moves to engage with the first component is the same as a direction that the latch element moves from the first position to the second position, wherein pushing the latch element by means of the rotating member allows successively the second component to be engaged with the first component and the latch element to move from the first position to the second position, wherein the rotating member is provided with a rotating shaft at one end and wherein the rotating member rotates so that a middle portion thereof pushes the latch element.

2. The electrical connection system as in claim 1, wherein the rotating member restricts both movement of the latch element to the first position and cancellation of engagement of the second component with the first component when the rotating member is fixed on the first component by means of the fixing unit.

3. The electrical connection system as in claim 1, wherein the rotating member is formed into the shape of a cover so as to cover the second component engaged with the first component.

* * * * *